United States Patent [19]

Guittard et al.

[11] Patent Number: 4,536,679

[45] Date of Patent: Aug. 20, 1985

[54] PHOTOCATHODE

[75] Inventors: Pierre Guittard, Montlhery Longpont; Bernard Guillemet, Vitry-sur-Seine; Claude Piaget, Montgeron, all of France

[73] Assignee: U.S. Philips Corporation, New York, N.Y.

[21] Appl. No.: 439,145

[22] Filed: Nov. 4, 1982

[30] Foreign Application Priority Data

Nov. 4, 1981 [FR] France ..... 81 20675

[51] Int. Cl.[3] ..... H01J 40/16; H01J 40/06

[52] U.S. Cl. ..... 313/541; 313/544

[58] Field of Search ..... 313/530, 541, 542, 544, 313/373

[56] References Cited

U.S. PATENT DOCUMENTS

| | | | |
|---|---|---|---|
| 4,008,402 | 2/1977 | O'Keeffe et al. | 313/471 X |
| 4,038,576 | 7/1977 | Hallais et al. | 313/542 |
| 4,311,743 | 1/1982 | Kasper et al. | 313/542 X |
| 4,490,605 | 12/1984 | Dolizy et al. | 313/541 X |

*Primary Examiner*—Palmer DeMeo
*Assistant Examiner*—Sandra L. O'Shea
*Attorney, Agent, or Firm*—Robert T. Mayer; Steven R. Biren

[57] ABSTRACT

The photocathode is of the type which comprises a photo-emissive layer consisting of at least an active layer of the P-type, a solid support for said semiconductor of a material which is transparent to radiation, a layer having a bonding glass for the photo-emissive layer on the support. The invention is characterized in that the support comprises two parts situated one on top of the other and which are bonded together, namely a thick second part (thickness for example 5 mm) of a type of glass having properties of thermal expansion which are substantially identical to those of the bonding glass and a part in the form of a disk-shaped first part (thickness for example 1 mm) of a material having softening and transition points which are much higher than those of the bonding glass and of the glass of the thick part.

2 Claims, 3 Drawing Figures

PHOTOCATHODE

BACKGROUND OF THE INVENTION

The invention relates to a photocathode comprising on a transparent support successively a glass bonding layer, a passivating layer and a photo-emissive layer.

Such a photocathode is known from French patent No. 2,300,413.

One of the problems occurring in the manufacture of such photocathodes relates to the connection of the photo-emissive layer to the support. During said connection the crystal properties of the photo-emissive layer on which the future photo-emission properties depend should not be spoiled or disturbed.

Another problem is that as soon as the connection has been made the formed assembly must be capable of withstanding a thermal treatment at high temperature which precedes the activation of the photo-emissive layer so as to make said layer photo-emissive by the supply of, for example, caesium, without the crystal properties of the semiconductor being disturbed.

A second problem relates to the connection of the support to an envelope of a tube. The support must give the photocathode a good mechanical rigidity. Therefore it must be thick. Moreover the support is connected with its edge to the envelope of a tube. Hence said edge must project sufficiently beyond the surface of the photo-emissive layer so that welding to the envelope does not spoil the photo-emissive layer. As a result of the large thickness and the large area the support has a rather large volume. Therefore, in order not to augment the costs of the tube it is desirable that the material of the support should not be too expensive.

U.S. patent No. 3,769,536 suggests making said support from glass, the photo-emissive layer being bonded to the glass at a suitable temperature. Although the use of glass has the advantage of being cheap, it also has disadvantages. Also, when a glass is used the properties of thermal expansion and the melting and softening points which have been adapted to those of the photo-emissive layer in such manner that welding is facilitated thereby, the required temperatures are disadvantageous for the crystal properties of the semiconductor material of the photo-emissive layer. This is probably because during welding the glass of the support is brought to a high temperature and very large stresses are formed in the glass during cooling. The thermal treatment of the assembly obtained after welding prior to the caesium treatment of the semiconductor, for the glass, is comparable with the beginning of a firing treatment. The stresses of the glass are liberated and introduce other stresses in the semiconductor material so that the crystal structure is disturbed.

In French patent No. 2,300,413, the photo-emissive layer is sealed on a support of monocrystalline oxide (for example, corundum) by means of a bonding glass, the coefficients of expansion of the photo-emissive layer, of the bonding glass and of the oxide of the support being mutually adapted, the transition and softening temperatures of the oxide being much higher than those of the bonding glass and of the photo-emissive layer. During said melting operation the monocrystalline oxide of the support is heated to temperatures which are much lower than those of the transition point thereof in such manner that after said melting no stresses are formed upon cooling which may be liberated during the later thermal treatment. During the bonding operation and thermal treatment the monocrystalline oxide to a certain extent plays the role of stiffener which results in preserving the crystalline properties of the photo-emissive layer. Furthermore, the good thermal conductivity of the oxide is very attractive during the thermal treatment of the photo-emissive layer after sealing. To the contrary, said monocrystalline oxide, irrespective of its nature, always is an expensive material which increases the price of the photocathode and hence the electron tube.

SUMMARY OF THE INVENTION

It is the object of the invention to provide a photocathode the structure of which presents the same advantages as the structure according to the abovementioned French Patent but at a lower cost. For that purpose, the invention proposes a photocathode of the same general structure as that according to said French Patent but which is characterized in that the support consists of two disk-shaped parts which are secured one on top of the other and the former of which consists of a glass having softening and transition points which are higher than those of the glass of the bonding layer, on which former part the bonding layer, the passivating layer and the photo-emissive layer are provided and of which the latter part is manufactured from a glass having softening and transition points and properties of thermal expansion which are substantially equal to those of the glass of the bonding layer, the second disk-shaped part projecting with its edge beyond the former part, said edge being suitable for the connection to the envelope of an electron tube.

The method of manufacturing such a photocathode comprises the same steps as those described in French patent No. 2,300,413, in particular the assembly step for providing the semiconductor on the said first part and that of the latter on the said second part. Said assembling is carried out by heating the assembly at a temperature in the order of 600° to 700° C. in accordance with the nature of the materials and under a pressure in the order of 1 to 5 kg/cm$^2$ perpendicularly to the surfaces. During assembly, the subsequent cooling and the thermal treatment preceding the photo-electric activation of the semiconductor the first part of the support is present as a sandwich between two glass layers which, due to the substantially identical expansion proerties thereof, exert on the first part equal and opposite mechanical forces. Thus the part does not experience any bending forces which may cause stresses in the semiconductor. On the other hand, the said part does not collect stresses which are liberated in the semiconductor due to the high transition point of the material of which it consists. During the construction of the photocathode it thus plays the role of stiffener, just as the monocrystalline oxide of the support of the French Patent No. 2,300,413. The material of said first part having a high transition point is generally expensive but because this forms only a small part of the support (thickness of the first part in the order of, for example, 1 mm, thickness of the second part in the order of approximately 5 mm), it hardly increases the cost of the total support.

According to a first modified embodiment the material of the first part is an oxide or a monocrystalline or polycrystalline oxide compound, for example corundum, while the bonding glass and the glass of the second part of the support are substantially identical and have a composition, in mol percent, selected from the following compositions (A), (B) and (C):

| | | |
|---|---|---|
| (A) | CaO | 15 to 35% |
| | $B_2O_3$ | 45 to 70% |
| | $Al_2O_3$ | 10 to 20% |
| (B) | BaO | 10 to 35% |
| | $B_2O_3$ | 45 to 70% |
| | $Al_2O_3$ | 10 to 20% |
| (C) | CaO | 20 to 30% |
| | $B_2O_3$ | 50 to 60% |
| | $Al_2O_3$ | 5 to 10% |
| | $SiO_2$ | 10 to 15% |

According to a second modified embodiment the material of the first part is a type of glass the transition and softening points of which are much higher than those of the sealing and of the thermal treatments after the sealing, the types of bonding glass and the glass of the second part being those stated above.

In all these embodiments the semiconductor on the support side has at least one passivating layer, either a chemical passivating layer, or an electric passivating layer. The chemical passivation is obtained by means of a layer of an oxide, for example, silicon dioxide or a semiconductor oxide obtained by anodization, in order to avoid the chemical decomposition of the semiconductor during sealing. The passivation from an electric point of view is carried out by means of a layer of semiconductor material having a large forbidden bandwidth ("gap" in the order of 1.3 to 2 eV) doped with P, which minimizes as much as possible the recombination rate of the electrons at the interface between glass and photo-emissive layer. For a better optical matching of the photo-emissive layer to the support a layer of $Si_3N_4$ is preferably deposited on the photo-emissive layer the refractive index (2.2) of which is such as to be between that of the semiconductor (3.3) and that of the chemical passivating layer (1.5) so that the losses at the interface between glass and photo-emissive layer are minimized.

In order to obtain a photo-emissive layer one may resort to known epitaxy methods which are indicated in Patent No. 2,300,413 and the addition thereto Certificate of Addition No. 76 26 624 now French Patent Specification No. 2,343,333. These are briefly stated in the following description of several embodiments of the invention which are given by way of non-limiting example and the specification.

DESCRIPTION OF THE PREFERRED EMBODIMENTS

Figure 1:
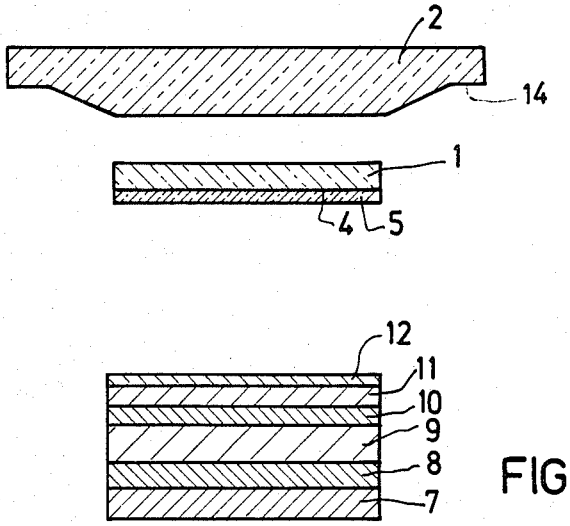
FIGS. 1 and 2 are longitudinal sectional views of a cathode according to the invention in various stages of its manufacture.

FIG. 1 shows, one above the other, the support and the photo-emissive layers with intermediate layers during processing. The support has two parts, namely part 1 in the form of a disk in a thickness in the order of 1 mm, having a high softening point (for example higher than 800°), and a part 2 having two parallel surfaces and a larger thickness in the order of, for example, 5 mm, of glass the softening point of which is much lower than that of the material of part 1. Part 2 projects with its edge 14 well beyond part 1. Said edge 14 serves to connect the photocathode to the envelope of the tube. One of the surfaces 4 of part 1 is covered with a glass bonding layer 5 the properties of thermal expansion of which are comparable to those of the material of part 1 and also of part 2, while the melting point is significantly lower than that of the material of part 1. During processing the photo-emissive layer is, for example, of the type having an active layer of binary material of the type GaAs. For this purpose, a first layer 8 of a ternary compound Ga, Al, As, having a doping type N or P, is deposited on the substrate 7 of GaAs. An active layer 9 which is doped with GaAs of the P-type is then grown on the said layer 8 by epitaxy, succeeded by a so-called electric passivating layer 10 of Ga, Al, As which necessarily is of the P-doping type. On said layer 10 an optical adaptation layer 11 is preferably deposited of $Si_3N_4$, then a chemical passivating layer 12 of silicon dioxide $SiO_2$. The thickness of the electric passivating layer 10 is by way of example in the order of 10 to 20$\mu$, that of the optical adaptation layer in the order of 1000 Å and that of the silicon oxide in the order of 500 to 2000 Å.

Figure 2:
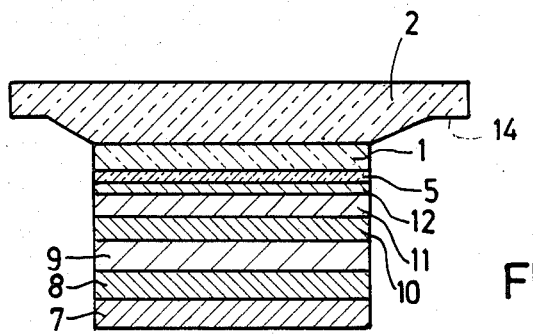
Figure 3:
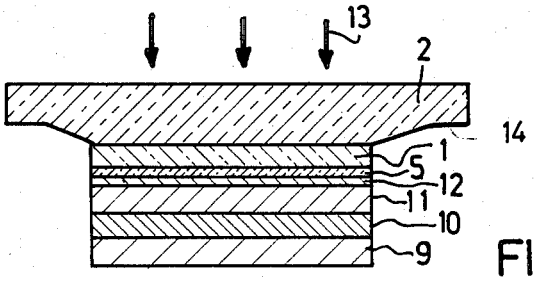
FIG. 3 is a longitudinal sectional view of a particular embodiment of the invention.

FIG. 2 shows the same element in which the glass bonding layer 5 is in contact with the layer 12. In this stage of the manufacture the assembly is transferred to a neutral or slightly reducing atmosphere under a pressure of 1 to 5 kg/cm$^2$ and at a temperature of 620° to 650° C. The combined action of temperature and pressure on the one hand results in the welding of 1 on 2 and on the other hand that of layer 12 on bonding layer 5. The substrate 7 and the layer 8 are then selectively etched by means of suitable successive chemical melts. The structure shown in FIG. 3 is then obtained, which can be connected to the envelope of an electron tube, the photocathode receiving radiation from without in the direction of the arrows 13. Before being assembled in the tube, said structure is subjected to the known activation treatment in which the window is provided in a vacuum, cleaned by heating, for example by ion bombardment, and the free surface of the photo-emissive layer is covered with at least an activating layer (caesium, oxygen). During said treatments the whole structure may be heated to a temperature in the order of 630° C. It might be feared that during the connection of the photo-emissive layer to the support and during the cleaning activities preceding the caesium treatment, stresses are introduced from the support into the photo-emissive layer and disturb the crystal structure thereof, and consequently reduce the anticipated photo-electric yield. On the one hand, however, part 1 of a material having a transition temperature which is much higher than that for bonding and the thermal treatments during said treatments and the subsequent cooling does not collect stresses which are liberated and may be introduced into the semiconductor. On the other hand, because the elements 5 and 2 present on either side of part 1 consist of glass the properties of expansion of which are substantially identical, these exert substantially identical and opposite mechanical stresses on part 1 after cooling so that this part is not subject to deformation which may produce interferences in the semiconductor. By this method, the electric properties of the active layer of GaAs can be maintained in such manner that the diffusion length of the electrons in the layer is at least in the order of 6 $\mu$m by a P-type doping having a concentration in the order of $10^{19}$ atoms/cm of, for example, zinc or germanium.

According to a first modified embodiment the material of the plate which is to form the support is an oxide or a monocrystalline or polycrystalline oxide compound, for example, corundum or spinel of the chemical formula $MgO\text{-}3.5\ A1_2O_3$, while the bonding glass or the glass of the second part of the support are identical.

According to a second modified embodiment the material of the plate is a kind of glass of which the softening and transition temperatures are significantly higher than those necessary for bonding and for the thermal treatments which precede the caesium treatment of the semiconductor. The types of bonding glass and the glass of the second part have a composition which is indicated hereinbefore. The material of the first part of the support is, for example, a kind of glass which is manufactured by Messrs. Schott (West Germany) and recorded in the catalogue of said firm under the numbers 8409 and 8436.

What is claimed is:

1. A photocathode comprising a transparent support bonded by a glass bonding layer to a semiconductor structure comprising a chemical passivating layer on an optical adaptation layer on an electrical passivating layer on a photoemissive layer, the transparent support acting as the window of a tube envelope, wherein the improvement comprises the support being in two parts bonded together as follows:

a first part connected to the glass bonding layer and thereby to the chemical passivating layer of the semiconductor structure, this first part comprising a glass having softening and transition temperatures which are higher than those of the glass bonding layer, and a second part for connection to the tube envelope, said second part comprising a glass having softening and transition temperatures and properties of thermal expansion substantially equal to those of the glass bonding layer.

2. A photocathode as claimed in claim 1, wherein the glass bonding layer has a softening temperature between 600° C. and 700° C.

* * * * *